US007645319B2

(12) United States Patent
Dubettier-Grenier et al.

(10) Patent No.: US 7,645,319 B2
(45) Date of Patent: Jan. 12, 2010

(54) METHOD FOR RENOVATING A COMBINED BLAST FURNACE AND AIR/GAS SEPARATION UNIT SYSTEM

(75) Inventors: Richard Dubettier-Grenier, La Varenne Saint Hilaire (FR); Michel Devaux, Roissy En Brie (FR); Jean-Marc Peyron, Creteil (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 220 days.

(21) Appl. No.: 10/589,936

(22) PCT Filed: Feb. 11, 2005

(86) PCT No.: PCT/FR2005/050089

§ 371 (c)(1),
(2), (4) Date: Aug. 18, 2006

(87) PCT Pub. No.: WO2005/085727

PCT Pub. Date: Sep. 15, 2005

(65) Prior Publication Data

US 2007/0170624 A1 Jul. 26, 2007

(30) Foreign Application Priority Data

Feb. 27, 2004 (FR) ..... 04 50371

(51) Int. Cl.
*C21B 5/00* (2006.01)
*B01D 53/00* (2006.01)

(52) U.S. Cl. ..... 75/379; 75/387; 75/468; 95/19; 95/23

(58) Field of Classification Search ..... 75/379, 75/387, 468; 95/19, 23
See application file for complete search history.

(56) References Cited

U.S. PATENT DOCUMENTS 4,022,030 A 5/1977 Brugerolle (Continued)

FOREIGN PATENT DOCUMENTS

EP 0 531 182 3/1993

(Continued)

OTHER PUBLICATIONS

International Search Report for PCT/FR2005/050089, Dec. 5, 2005.

(Continued)

*Primary Examiner*—George Wyszomierski
*Assistant Examiner*—Tima M McGuthry-Banks
(74) *Attorney, Agent, or Firm*—Christopher J. Cronin

(57) ABSTRACT

The invention relates to a method for renovating a combined system consisting of a blast furnace supplied with an oxidant fluid received at least partly from an air/gas separation unit (ASU). The method consists in injecting, before renovation, at least 50% of the flow rate of the blower feeding the blast furnace into an ASU to produce oxygen whose purity is greater than 90% by volume of $O_2$ which feeds the blast furnace, in controlling the blower airflow rate and the pressure of the air derived therefrom by a regulator which measures the flow rate and/or pressure at the input and/or output of a cleaning stage which is mounted upstream of the separation unit to control the flow rate and pressure of the air derived from the blower. The fluid feeding the blast furnace consists of pure oxygen or diluted by air produced by the cryogenic separation unit.

6 Claims, 3 Drawing Sheets

U.S. PATENT DOCUMENTS

| | | | | |
|---|---|---|---|---|
| 5,244,489 | A | 9/1993 | Granier | |
| 5,582,036 | A * | 12/1996 | Drnevich et al. | 62/656 |
| 5,802,875 | A * | 9/1998 | Drnevich | 62/656 |
| 6,045,602 | A * | 4/2000 | Shah et al. | 75/466 |
| 6,062,043 | A * | 5/2000 | Magnet et al. | 62/643 |
| 6,089,040 | A | 7/2000 | Guillard | |
| 6,622,521 | B2 * | 9/2003 | Seiver et al. | 62/656 |
| 6,697,713 | B2 * | 2/2004 | Megan et al. | 700/301 |
| 2003/0000342 | A1 * | 1/2003 | Ha et al. | 75/486 |
| 2003/0213688 | A1 * | 11/2003 | Wang et al. | 203/1 |

FOREIGN PATENT DOCUMENTS

| | | |
|---|---|---|
| EP | 0 932 006 | 7/1999 |

OTHER PUBLICATIONS

Patent Abstracts of Japan, vol. 0103, No. 35, Nov. 13, 1986, & JP 61 139609, Jun. 26, 1986.

Capogrosso, L. et al. *Optimising oxygen enrichment to blast furnaces using coal injection*. Steel Times International (inc. Steel Times), DMG World Media, Redhill, Surrey, GB, vol. 27, No. 2, Feb. 2003, pp. 20, 22-23.

Patent Abstract of Japan, vol. 2000, No. 19, Jun. 5, 2001, & JP 2001 049313, Feb. 20, 2001.

* cited by examiner

METHOD FOR RENOVATING A COMBINED BLAST FURNACE AND AIR/GAS SEPARATION UNIT SYSTEM

The present invention relates to a method for revamping a combined system consisting of a blast furnace supplied with oxidizing fluid issuing at least partially from an air gas separation unit (ASU).

To enrich an air stream with oxygen, the production of high purity oxygen is not required, and the use of a distillation apparatus comprising a mixing column as described in document U.S. Pat. No. 4,022,030 (Brugerolle) is suitable. Combined systems consisting of a blast furnace and an air distillation apparatus comprising such a mixing column are described, for example, in documents U.S. Pat. No. 5,244,489 (Grenier) and EP-A-0 531 182 in the name of the applicant. However, the approaches followed in these two documents are opposed: in document U.S. Pat. No. 5,244,489, the distillation apparatus is fully supplied with air by a branch of the stream from a blast furnace blower, and the portion of the air stream supplied by the mixing column is slightly pressurized by a booster driven by a cold-maintaining turbine that expands the portion of the air stream sent to the medium pressure column, in an arrangement which, to effect said pressurizing, requires a large part of the air feed for the medium pressure column to pass through the turbine, causing extraction yield and energy losses, and also oversizing of the cooling and cleaning stations for the air feed to the distillation apparatus. Conversely, document EP-A-0 531 182 provides for a complete separation of the air feeds a) to the blast furnace b) to the medium pressure column and c) to the mixing column, using separate compression means for, in particular, producing impure oxygen at high or low pressures in the mixing column, in an arrangement that is costly in terms of investment and operation of rotating machines, and does not provide for any synergy between these units.

EP-A-0 932 006 proposes a combined system and a method for using such an intensively integrated combined system and obtaining substantially lower operating costs, while offering flexibility in selecting the operating ranges.

For this purpose, the proposed method is of the type comprising at least one furnace supplied with air by at least one blower supplying air at a first pressure $P_1$, and with oxygen supplied by at least one air distillation apparatus comprising at least one medium pressure column at least partially supplied with air by the furnace blower, and a mixing column supplying the oxygen to the furnace, and in which the mixing column is supplied with air by a compressor compressing the air to a pressure $P_2$ higher than $P_1$.

According to a particular feature, the medium pressure column is supplied exclusively with compressed air supplied by the furnace blower.

Within the framework of environmental conservation programs, use is often made of oxycombustion in the boilers because of the higher efficiency of this type of process (the nitrogen present in the air is not heated needlessly and a gas very rich in $CO_2$ and containing very little $N_2$ can be recovered directly) and because of the limitation of $NO_x$ emissions, particularly by the combustion of industrially pure oxygen (above 90% oxygen).

For the blast furnace, this is hence reflected by the injection of pure oxygen (or oxygen diluted with air) in order to obtain over 50% by volume of oxygen in the stream sent to the blast furnace, preferably over 80% oxygen and more preferably over 90 vol % oxygen.

However, a conventional air blast furnace features an air blower with a potentially extremely high flow rate at a pressure equal to or greater than $2.5\times10^5$ pascals, which is little needed, if at all, in a "highly oxygenated oxygen stream" process as described above.

In fact, either no air at all is injected into the blast furnace, or a very small quantity (less than 25% of the capacity of the blower or blowers) is injected to dilute the oxygen, leaving a blower which operates below its minimum capacity, requiring it to produce more and to recycle the surplus production, or to discharge the surplus to the atmosphere, which is a poor and extremely costly solution in terms of energy in both cases.

The technical problem to be solved hence consists in efficiently and economically reusing an air blower available on the blast furnace site.

The proposed solution consists in controlling this blower flow rate and/or pressure by a controller of which the measurement and setpoint derive from the ASU (typically from the cleaning unit (inlet or outlet air flow rate), or from the precooling (air flow rate between blower outlet and cleaning inlet), or from the suction of a second machine (suction pressure of an additional compressor)).

The method of the invention is characterized in that more than 50% of the flow from the blower feeding the blast furnace before revamping is injected into a cryogenic air gas separation unit in order to produce oxygen with a purity above 90% by volume of $O_2$ fed to the blast furnace, the blower air flow rate and/or pressure of the air issuing from the blower being controlled by a controller which measures this flow rate and/or pressure at the inlet and/or outlet of the air cleaning stage, placed upstream of the separation unit, in order to control the flow rate or pressure of the air issuing from the blower, the blast furnace feed fluid consisting of pure oxygen or oxygen diluted with air produced by the cryogenic separation unit.

According to the invention, the air is supplied in part or in full by at least one blast furnace blower, the air flow thus supplied accounting for over 50% of the compressed air flow delivered by said at least one blower.

At least one blower flow rate and/or pressure is preferably controlled by a controller of which the measurement and setpoint derive from the ASU (typically from the cleaning unit (inlet or outlet air flow-rate), or from the precooling (air flow rate between blower outlet and cleaning inlet)).

According to a first variant of the invention, the air is supplied in part or in full by at least one blast furnace blower, the air flow thus supplied accounting for over 50% of the air flow compressed by the blower(s), while at least one blower flow rate is controlled by a controller of which the setpoint is calculated from the flow rate of one of the products issuing from the ASU (oxygen, nitrogen and/or argon in liquid or gaseous form).

Preferably, the compressed air issuing from the blower is cooled to a temperature of 50° C. or lower, and then, optionally, recompressed in a second compressor or blower, before being sent to a cleaning unit upstream of the ASU.

According to another variant of the invention, the blower flow rate is controlled by a FIC controller of which the measurement and setpoint derive from the ASU (typically from the cleaning unit (inlet or outlet air flow rate), or from the precooling (air flow rate between blower outlet and cleaning inlet)), while the additional compressor does not comprise any specific flow control.

According to another variant of the invention, the blower is controlled by a PIC controller of which the measurement and setpoint are applied to the fluid (air) at the recompressor suction, while the additional compressor is controlled by a FIC controller of which the measurement and setpoint derive from the ASU (typically from the cleaning unit (inlet or outlet air flow rate) or from the precooling (air flow rate between blower outlet and cleaning inlet)).

Finally, the ASU can also produce (in gaseous or liquid form) oxygen and/or nitrogen and/or argon and/or "instrument" air for a use other than the blast furnace.

According to one variant, the method of the invention is characterized in that the blower is controlled by a PIC controller of which the rate or pressure measurement and the setpoint value are determined from the fluid entering the second compressor.

BRIEF DESCRIPTION OF THE DRAWINGS

The invention will be better understood from the following embodiments provided as nonlimiting examples, jointly with the figures which show:

In FIG. 1, the compressed air from the blower 1 is sent via the line 2 into cooling means 3 and then via the line 5 to the "top" cleaning unit connected by the line 6 to the ASU 9 which delivers oxygen via the line 10 to the blast furnace 11, at point 12. A FIC controller 7 controls the blower 1 via the electrical connections 8 and 13, by the method described above.

In FIG. 2, which is a variant of FIG. 1, the same elements have the same numerals. The control parameters are measured here in the oxygen stream entering the blast furnace, via the oxygen flow controller 14, connected to an instrument 15 which calculates the setpoint FY of the FIC 17 which controls, via 18 and 13, the flow rate and/or pressure of the air delivered by the blower 1 to the cleaning unit 5.

FIG. 3 shows a variant of the preceding figures with the injection of cooled air at 3 into the recompressor 19 which supplies the cleaning unit 5. The FIC controller 21 on line 6, measures the flow rate and/or pressure of the air at this particular point (as in FIG. 1) and transmits the data via 23 and 24 to the recompressor 19. Another PIC controller 25 measures the flow rate and/or pressure of the air leaving the cooling means 3 and controls the blower 1 via 26 and 13 as described above.

Figure 1:
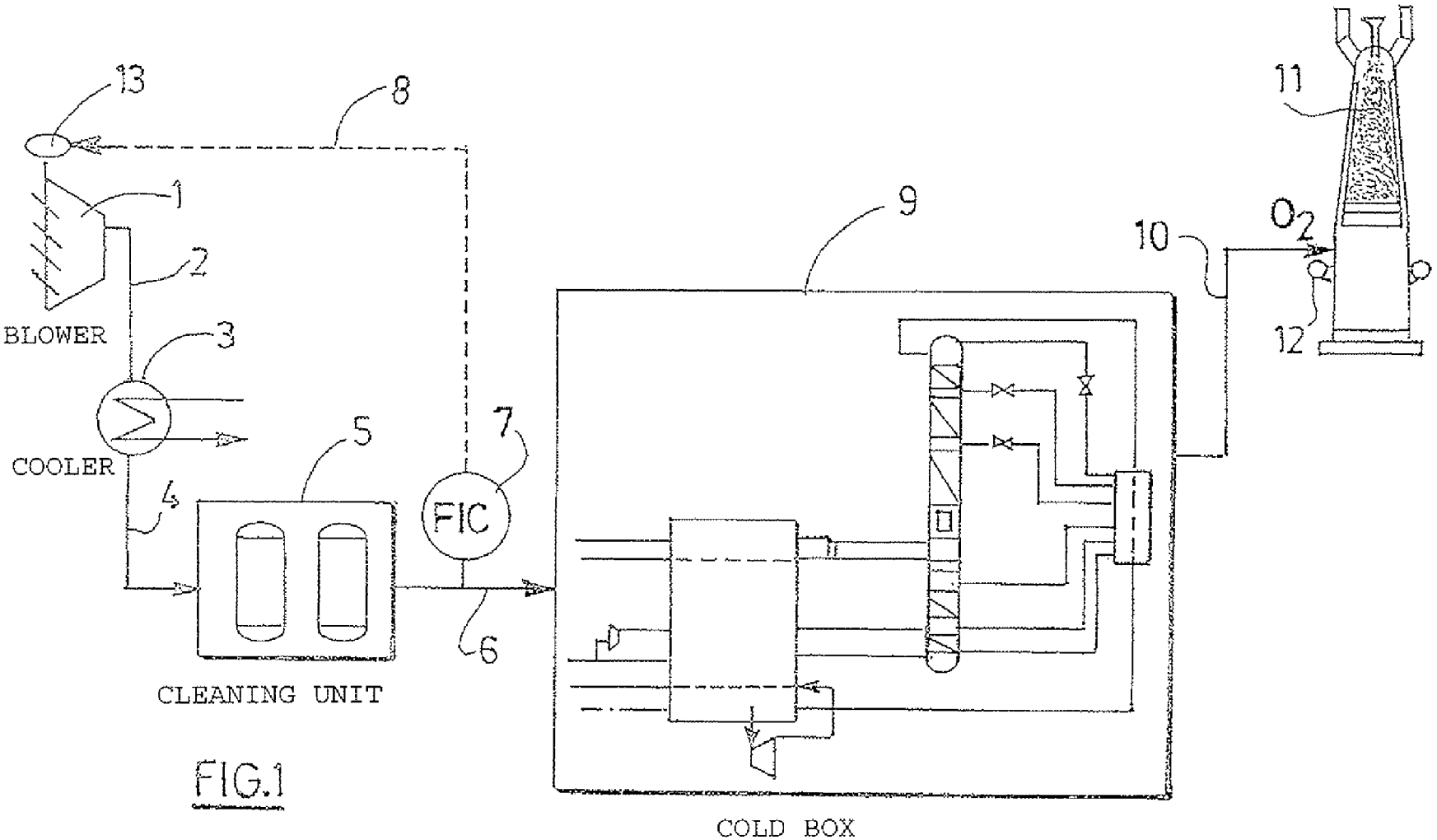
FIG. 1, an illustration of the invention.
Figure 2:
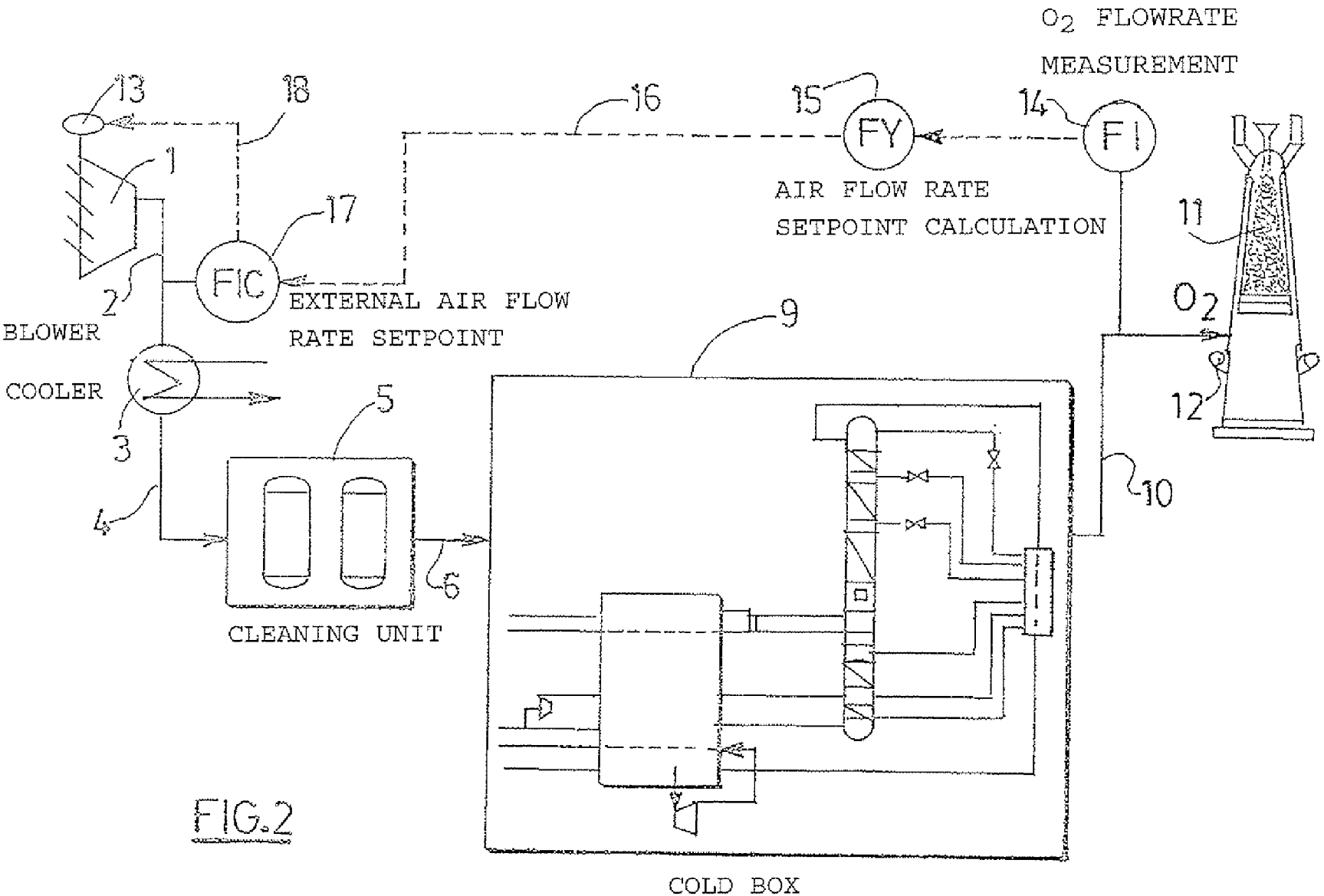
FIG. 2, a variant of FIG. 1.
Figure 3:
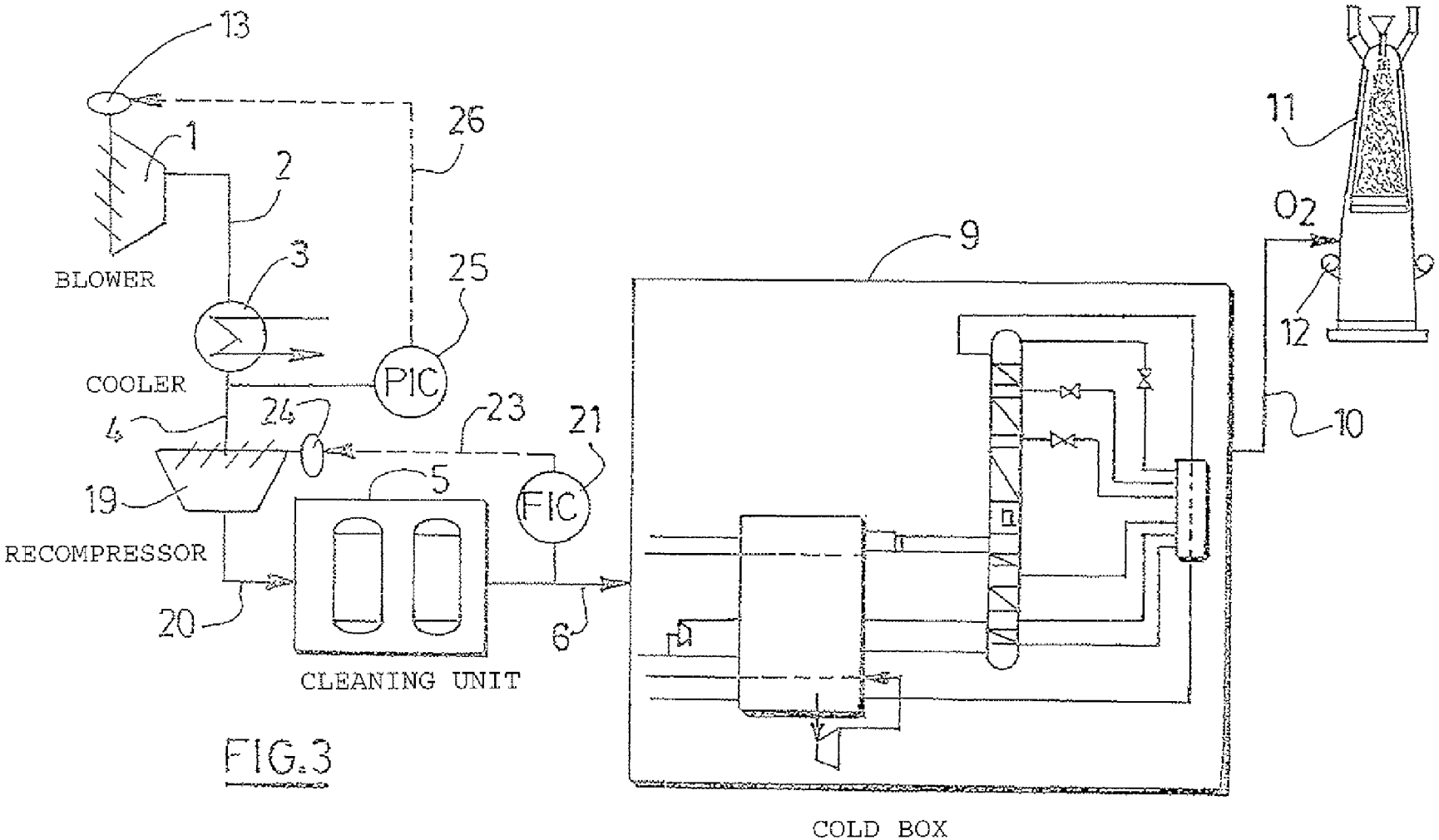
FIG. 3, a variant of the invention with a second compressor or blower.

The invention claimed is:

1. A method for revamping a combined system consisting of a blast furnace supplied with oxidizing fluid issuing at least partially from an air gas separation unit (ASU), wherein more than 50% of the flow from a blower feeding the blast furnace before revamping is injected into a cryogenic air gas separation unit in order to produce oxygen with a purity above 90% by volume of $O_2$, a post-revamping blast furnace feed fluid consisting of pure oxygen or oxygen diluted with air produced by the cryogenic separation unit, said oxygen of purity above 90% by volume of $O_2$ being fed to the blast furnace in order to obtain over 90% by volume of $O_2$ in the post-revamping blast furnace feed fluid, the blower air flow rate and/or pressure of the air issuing from the blower being controlled by a controller which measures this flow rate and/or pressure at the inlet and/or outlet of the air cleaning stage, placed upstream of the separation unit, in order to control the flow rate or pressure of the air issuing from the blower.

2. The method of claim 1, wherein the blower flow rate is controlled by a controller of which a setpoint is calculated from the flow rate and/or pressure characteristics of at least one of the fluids produced by the ASU.

3. The method of claim 1, wherein the air issuing from the blower is cooled to a temperature below 50° C. before being recompressed in a second compressor.

4. The method of claim 1, wherein the blower is controlled using a FIC controller of a measurement and setpoint derive from one of the fluids produced by the ASU.

5. The method of claim 1, wherein the blower is controlled by a PIC controller of which the flow rate or pressure measurement and of which a setpoint value are determined from the fluid entering the second compressor.

6. The method of claim 3, wherein the second compressor is controlled by a FIC controller, a measured parameters and setpoint issuing from the flow rate and/or pressure measurement of the ASU.

* * * * *